US007305951B2

(12) United States Patent
Fernandez et al.

(10) Patent No.: US 7,305,951 B2
(45) Date of Patent: Dec. 11, 2007

(54) TWO-STEP ROLLER FINGER FOLLOWER

(75) Inventors: Hermes A. Fernandez, Pittsford, NY (US); Andrew J. Lipinski, Henrietta, NY (US); Nick J. Hendriksma, Grand Rapids, MI (US); Thomas H. Fischer, Rochester, NY (US); Timothy W. Kunz, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/125,360

(22) Filed: May 9, 2005

(65) Prior Publication Data

US 2006/0249110 A1 Nov. 9, 2006

(51) Int. Cl.
*F01L 1/18* (2006.01)

(52) U.S. Cl. ..... 123/90.39; 123/90.43; 123/90.44; 123/90.2; 123/90.67; 74/559; 74/569

(58) Field of Classification Search ..... 123/90.39, 123/90.44
See application file for complete search history.

(56) References Cited

U.S. PATENT DOCUMENTS 5,099,806 A * 3/1992 Murata et al. ..... 123/90.16
5,515,819 A * 5/1996 Groh et al. ..... 123/90.16
5,524,580 A 6/1996 Muir
5,544,626 A * 8/1996 Diggs et al. ..... 123/90.16
5,615,647 A 4/1997 Nielsen
6,220,213 B1 * 4/2001 Haas et al. ..... 123/90.16
6,382,153 B1 5/2002 Rohe et al.
6,769,387 B2 8/2004 Hayman et al.
2004/0226523 A1 11/2004 Kreuter et al.

FOREIGN PATENT DOCUMENTS

DE 41 18 287 12/1992
DE 103 11 358 9/2004
EP 0 442 460 8/1991

OTHER PUBLICATIONS

EP Search Report dated Oct. 12, 2006.

* cited by examiner

*Primary Examiner*—Thomas Denion
*Assistant Examiner*—Kyle M. Riddle
(74) *Attorney, Agent, or Firm*—Paul L. Marshall

(57) ABSTRACT

A two-step roller finger follower having a high-lift follower portion that rotates relative to a low-lift follower portion about a pivot shaft, including a lost-motion compression spring disposed in a linear bore formed in the high-lift portion to exert force against an curved pad on the back side of the valve pallet of the low-lift portion. The spring is retained and guided in its bore by a spring retainer having a planar bottom for engaging the curved pad. Preferably the retainer is a cup positioned in the spring bore such that the stroke of the cup is limited, to prevent leak-down of the associated hydraulic lash adjuster. Driving the spring by a linear-acting retainer in a linear bore causes the spring to be compressed linearly, resulting in a highly stable and predictable spring rate.

7 Claims, 6 Drawing Sheets

TWO-STEP ROLLER FINGER FOLLOWER

TECHNICAL FIELD

The present invention relates to roller finger followers for actuating the valves of internal combustion engines; more particularly, to two-step roller finger followers for controllably activating and deactivating engine valves; and most particularly, to a two-step roller finger follower having a guided lost-motion compression spring.

BACKGROUND OF THE INVENTION

Two-step roller finger followers (RFF) for controllably activating compression valves in a variable valve actuation train in an internal combustion engines are well known. An RFF extends between a hydraulic lash adjuster (HLA) and the stem of a valve. Engagement with a cam lobe of an engine camshaft causes the RFF to be pivoted about the HLA and thereby to depress the valve stem, opening the valve. A two-step RFF mechanism allows an engine valve to be operated by two different cam lobe profiles, one with the mechanism locked and the other with the mechanism unlocked. When the mechanism is unlocked, the RFF portion that is not directly in contact with the valve stem and the HLA, known in the art as the high-lift follower, typically is provided with a spring means, known in the art as a "lost-motion" spring, to keep that portion in contact with the cam. A typical lost-motion spring is disposed in compression between the high-lift follower and the remainder of the RFF, known in the art as the low-lift follower. Thus, when the high-lift follower engages the cam lobe, all lash is removed from the RFF and force begins to be exerted by the spring against the HLA. If the force of the lost motion spring is too small, the high-lift follower may not be able to stay in contact with the cam under all engine operating conditions. If the spring force is too large, the force of the lost motion spring may overcome the force of the internal spring in the HLA causing the HLA to leak down and become undesirably compressed and depleted of oil.

In some prior art two-step RFFs, a torsional lost-motion spring is disclosed. See, for example, U.S. Pat. No. 6,769,387. Experience has shown that a torsional lost-motion spring can have excessive variation in its free angle, resulting in excessive variation in the installed load, making it difficult to balance the force of the torsional lost motion spring from being too large a force and too small a force. Further, a torsion spring exerts substantial friction in use, resulting in undesirably large hysterisis, again affecting the installed load.

It is known to employ compression lost-motion springs. See, for example, US Patent Application Publication No. US 2003/02003/0209216. A disadvantage of compression springs as disclosed in this publication is that the springs are not guided. Because the opposing spring seats follow rotational rather than linear paths, the springs can flex as well as compress in use, resulting in unstable spring dynamics and uncontrolled spring rates.

Compression lost-motion springs have been found to have significantly less load variation and less friction than torsional springs. However, actually implementing compression springs for this purpose is difficult because of the non-linearity of the actuating path and the limited space available in a typical two-step RFF structure.

What is needed in the art is a two-step roller finger follower having an improved arrangement of a compression lost-motion spring wherein frictional losses are minimized, spring compression is substantially linear rather than rotational, and spring length and diameter are maximized.

It is a principal object of the present invention to reduce frictional hysterisis and improve RFF working life cycle.

SUMMARY OF THE INVENTION

Briefly described, a two-step roller finger follower in accordance with the invention includes a high-lift follower portion that rotates relative to a low-lift follower portion about a pivot shaft. A lost-motion compression spring is disposed in a linear bore formed in the high-lift portion and exerts force against a radiused pad on the back side of the valve pallet of the low-lift portion. The spring is retained and guided in its bore by a spring retainer having a planar bottom for engaging the radiused pad. In an alternate embodiment the retainer is a cup positioned in the spring bore such that the stroke of the cup is limited to prevent load from being applied on the hydraulic lash adjuster when the cam is on base circle. Driving the spring by a linear-acting retainer in a linear bore causes the spring to be compressed linearly, resulting in a highly stable and predictable spring rate.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
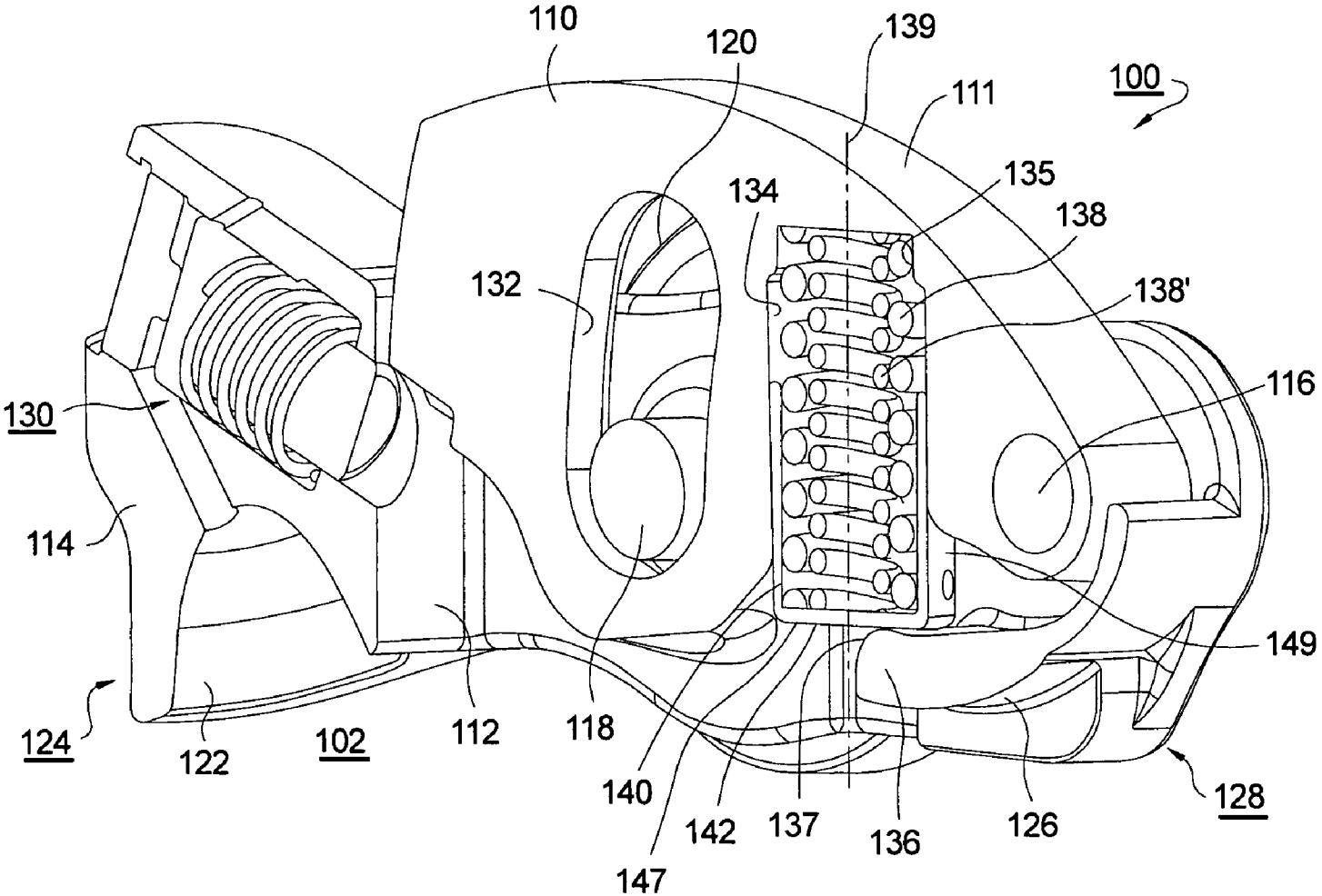
FIG. 1 is a cutaway isometric view of a two-step roller finger follower in accordance with the invention, showing a first embodiment of a follower spring.

Referring to FIG. 1, a first embodiment 100 of a two-step roller finger follower in accordance with the invention is formed generally in accordance with the two-step RFF prior art. Such a two-step RFF is suitable for use in a variable valve activation system of an internal combustion engine 102. The view shown in FIG. 1 represents a section cutaway along a vertical symmetry plane for description purposes such that only one-half of the RFF is present. Thus, where appropriate, the described elements should be considered as having matching but not shown counterparts in the full RFF.

A high-lift follower 110 including a cam-follower surface 111 is disposed in a central opening 112 in a generally box-shaped low-lift follower 114. High-lift follower 110 pivots within opening 112 about a pivot shaft 116. A roller shaft 118 mounted in low-lift follower 114 supports a roller 120 for following a low-lift lobe of an engine camshaft (not shown). Low-lift follower 114 includes a socket 122, for pivotably mounting RFF 100 at a first end 124 thereof on a hydraulic lash adjuster (not shown), and a pad 126 at a second end 128 thereof for actuating a valve stem (not shown). A latching assembly 130 disposed in low-lift follower 114 selectively latches high lift follower 110 in position to actuate the valve stem in response to the high-lift cam lobe base circle and eccentric, or selectively unlatches high-lift follower 110 to follow the high-lift cam lobe base circle and eccentric in lost motion. Curved slot 132 in high-lift follower 110 accommodates roller shaft 118 during the pivoting motions of high-lift follower 110 about pivot shaft 116. All of these relationships are known in the RFF prior art and need not be further elaborated here.

Referring still to FIG. 1, a blind bore 134 is formed in high-lift follower 110, opening adjacent curved shoe 136 formed in low-lift follower 114. In a currently-preferred embodiment, the surface 137 of shoe 136 is curved such that a radius of shoe 136 is parallel to the axis 139 of bore 134 at all positions of high-lift follower 110. Preferably, the surface of shoe 136 is cylindrical and thus has a constant radius, although a varying-radius non-cylindrical surface is fully comprehended by the invention and may be preferred in some instances to compensate for a non-linear spring rate. A first lost-motion compression spring 138 is compressively disposed within bore 134 and is retained therein by a cup-shaped spring retainer 140 having a preferably planar surface 147 on end 142, that rides on shoe 136, and cylindrical sidewall 149. Retainer 140 is slidably close-fitting within bore 134 such that the motion of retainer 140 is reciprocal and linear with lost-motion action of the RFF. Further, spring 138 is relatively close-fitting within retainer 140 and is centered in bore 134 by a concentric smaller-diameter bore portion 135.

Because shoe 136 makes continuous tangential contact with end surface 142, preferably over less than the full diameter of surface 142, as end surface 142 rotates along shoe surface 137 all thrust against shoe 136 is in a direction parallel to the axis 139 of bore 134. Thus, the compressive force on spring 138 is co-linear with axis 139, and there is no bending moment imposed on the spring, as opposed to the cited prior art.

The use of a curved, and preferably cylindrical, radius on surface 137 makes a line contact with end surface 142 and helps to minimize contact stress in end surface 142 in comparison to a prior art spherical bottom surface of the spring retainer. Also, this arrangement maximizes the length of the lost-motion spring in comparison to prior art spherical bottoms wherein an undesirably large portion of the potential spring space is consumed by the spherical bottom.

An advantage of a spring arrangement as shown in FIG. 1 is that second spring 138' may be disposed within spring 138 to augment the force capability thereof, thus increasing the force density capability within a single bore 134. Preferably the two springs are counter wound to prevent binding; this allows the springs to mutually support and center each other. Second spring 138' may be a low-rate spring and first spring 138 a high-rate spring, or vice versa.

Figure 1A:
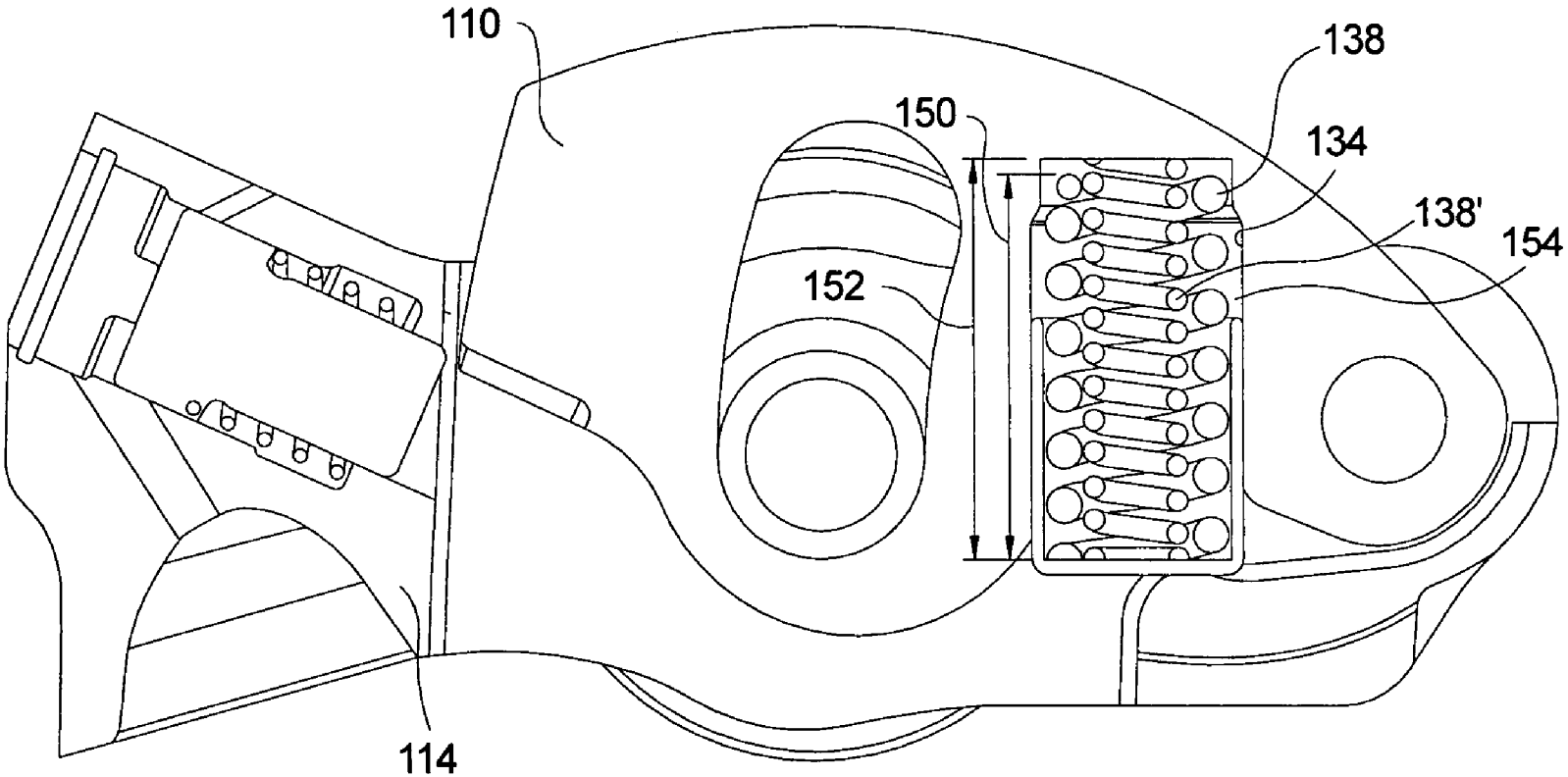
FIG. 1*a* is an elevational cross-sectional view of FIG. 1 showing an alternate arrangement of the lost motion springs.

FIG. 1*a* shows the position of high-lift follower 110 relative to low lift follower 114 when high lift follower 110 is on the base circle portion of the cam lobe. As shown, the free lengths of the springs may be sized such that only low-rate spring 138' is in contact when the high-lift follower is on the base circle portion of the cam lobe, thus preventing leakdown of the HLA. As shown, the free length 150 of high rate spring 138 is selected to be less than the length 152 of spring cavity 154 when the high-lift follower is on the base circle portion of the cam lobe so that high-rate spring 138 comes into effect only when the follower moves onto the eccentric portion of the cam lobe. Since the compression springs in accordance with the invention operate linearly and their operating lengths are less than they would be if they were disposed between roller shaft 118 and latching assembly 130, the range of operating spring forces can be selected to prevent undesirable HLA leak down of the HLA. While FIG. 1*a* shows outer spring 138 to have its free length controllably selected as discussed above, it is understood that the free length of the inner spring may be controllably selected instead.

Figure 2:
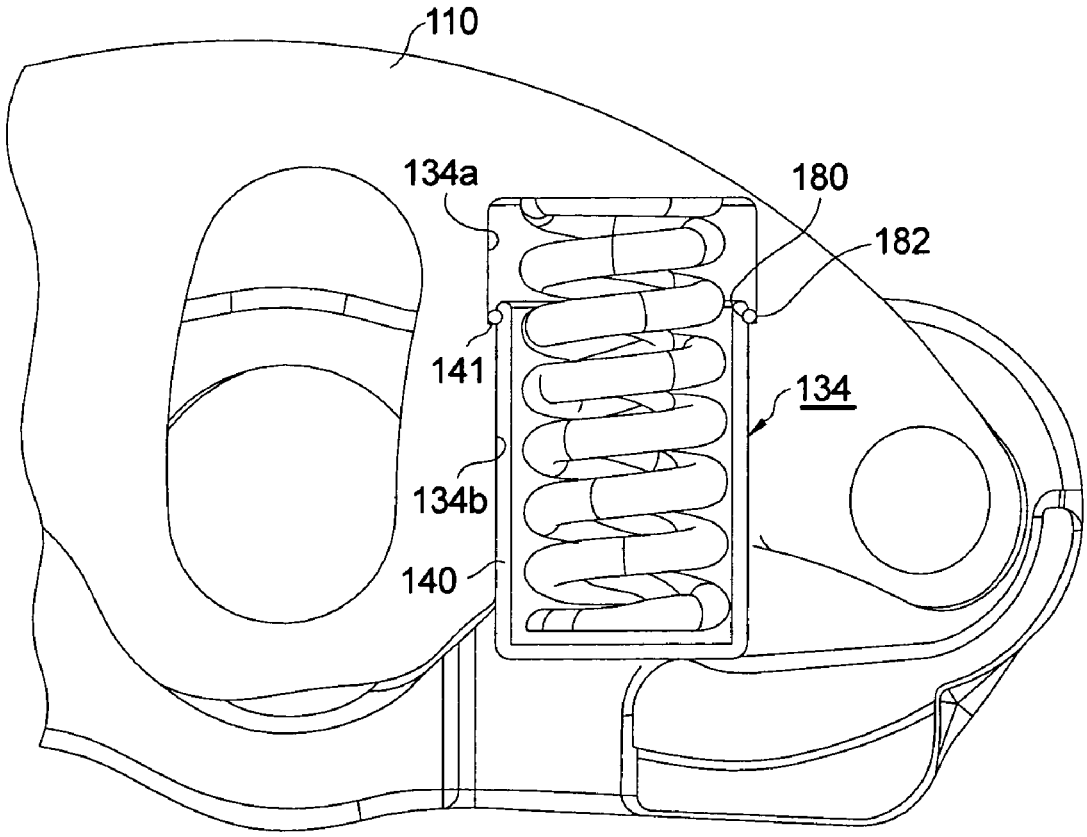
FIG. 2 is an elevational cross-sectional view of an RFF in accordance with the invention, showing an alternative embodiment of a spring-retaining cup for limiting spring travel to prevent HLA leakdown.

Another means for preventing HLA leakdown is to limit the outward extent of travel of spring retainer 140. Referring to FIG. 2, bore 134 is provided with a reverse shoulder or step 141 between a larger diameter portion 134*a* and a smaller diameter portion 134*b*. Retainer 140 includes an annular groove 180 and a spring clip 182. When the retainer and spring clip are first inserted into smaller diameter portion 134*b*, the depth of annular groove 180 permits spring clip 182 to be compressed inwardly to a diameter that fits within smaller diameter portion 143*b*. Then, when the retainer and spring clip pass through smaller diameter portion 134*b* into larger diameter portion 134*a*, the spring clip expands and thus cannot return into smaller diameter portion 134*b*, thus limiting the stroke of the retainer to the length of the larger diameter portion. The axial position of shoulder 141 is selected such that, at the permitted outward travel extreme of retainer 140, the high-lift follower surface 111 does not make contact with the base circle portion of its respective high-lift camshaft lobe, thus preventing further expansion of the lost motion springs and undesirable leakdown of the HLA.

Figure 3:
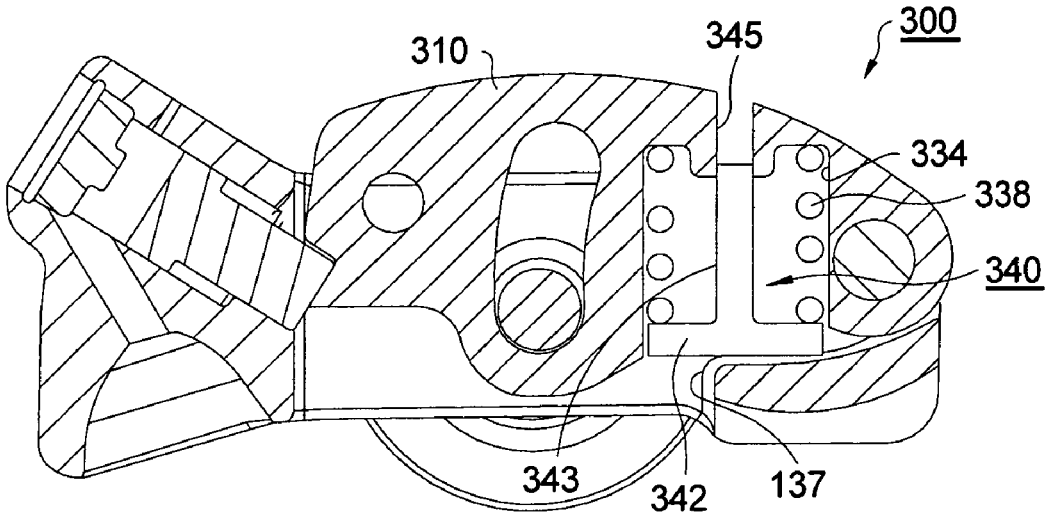
FIGS. 3 and 4 are elevational cross-sectional views of an RFF in accordance with the invention, showing a second alternative spring-guiding mechanism.
Figure 4:
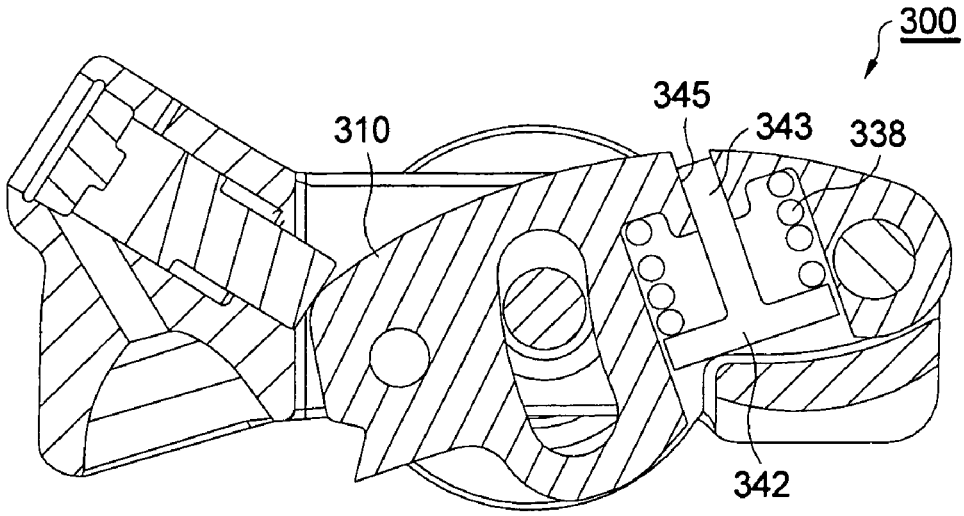

Referring to FIGS. 3 and 4, in a second embodiment 300 in accordance with the invention, bore 334 is formed such that spring 338 is nearly full-fitting diametrically. A spring retainer 340 comprises a head portion 342, for supporting spring 338 and for contacting shoe surface 137, and an axial stem portion 343 extending into a guide counterbore 345 formed in high-lift follower 310 that guides retainer 340 during reciprocation thereof between locked position (FIG. 3) and lost-motion position (FIG. 4).

Figure 5:
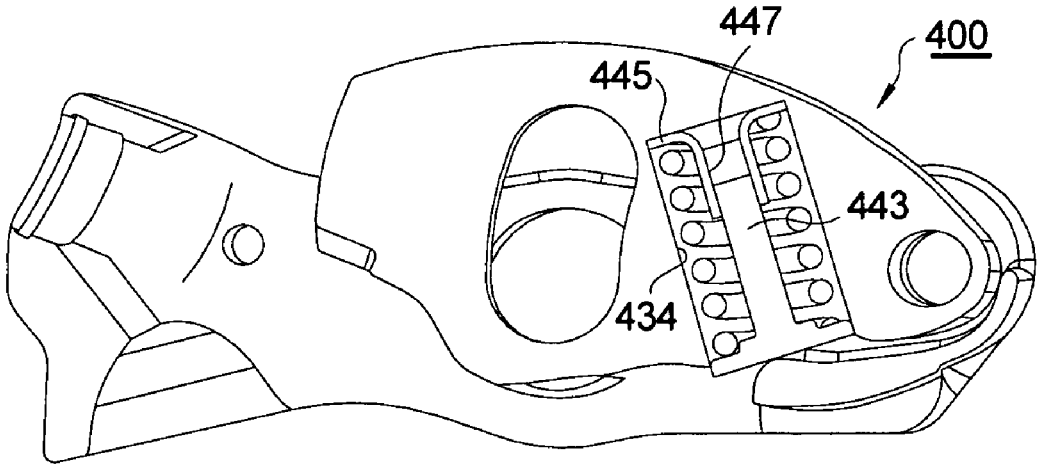
FIG. 5 is an elevational cross-sectional view of an RFF in accordance with the invention, showing a third alternative spring-guiding mechanism.

Referring to FIG. 5, in a third embodiment 400 the spring-guiding mechanism is similar to that shown in embodiment 300 except that the guide for stem portion 443 is a separate female guide element 445 inserted into bore 434 and having a central bore 447 for receiving stem portion 443.

Figure 6:
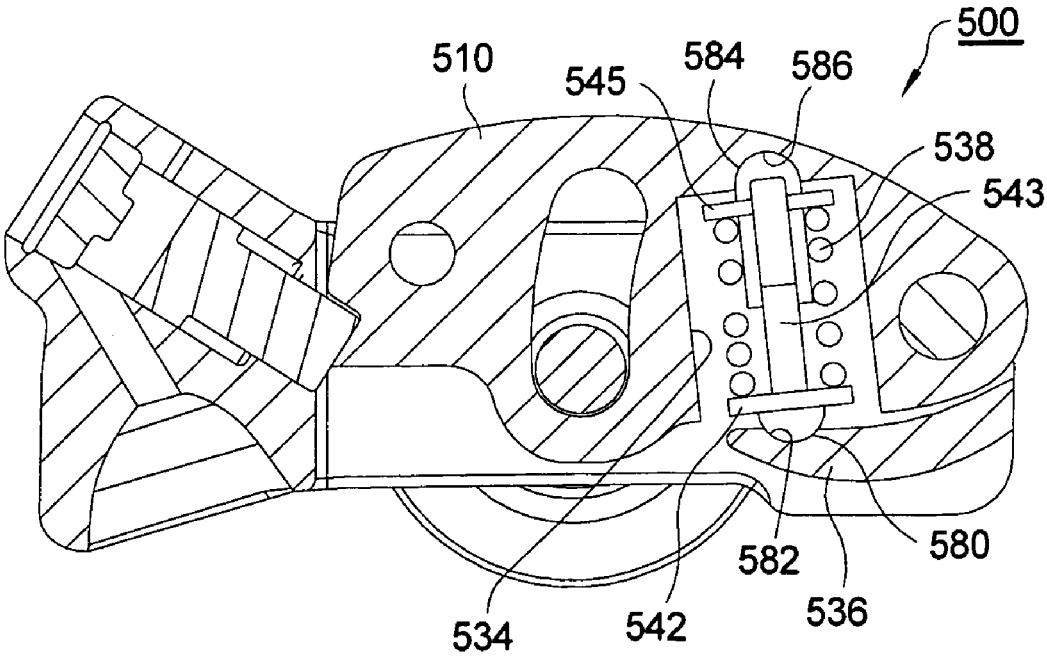
FIG. 6 is an elevational cross-sectional view of an RFF in accordance with the invention, showing a fourth alternative spring-guiding mechanism.

Referring to FIG. 6, in a fourth embodiment 500 the spring-guiding mechanism is similar to that shown in embodiment 400 except that head portion 542 is provided with a ball surface 580 for being received in a mating ball socket 582 in shoe 536; and female guide element 545 is similarly provided with a ball surface 584 for being received in a mating ball socket 586 formed in high-lift follower 510. The spherical centers of ball surfaces 580,584 lie on the axis of spring 538, head portion 542, and stem portion 543. This arrangement allows the spring force to be exerted linearly on the spring as in the previously-described embodiments.

In providing for a compression spring within a bore in a high-lift follower in accordance with the invention, space constraints are severe in providing a spring of adequate spring rate. If the bore is large, to accommodate a large-diameter spring, the follower can be structurally weakened. Thus there is a practical limit on the diameter of a bore. In a typical high-lift follower, the bore may have a maximum diameter of about 7 mm. If the bore is long, to accommodate a long spring, the follower can be similarly weakened. In embodiments 100 and 200, the spring diameter is constrained to about 6 mm by the necessary wall thickness of the cup-shaped spring retainer 140,240, resulting in a spring diameter sacrifice of about 14%. In embodiments 400 and 500, the length of the spring is constrained by the presence of guide elements 445,545 at the inner end of the bore 434,534.

Figure 7:
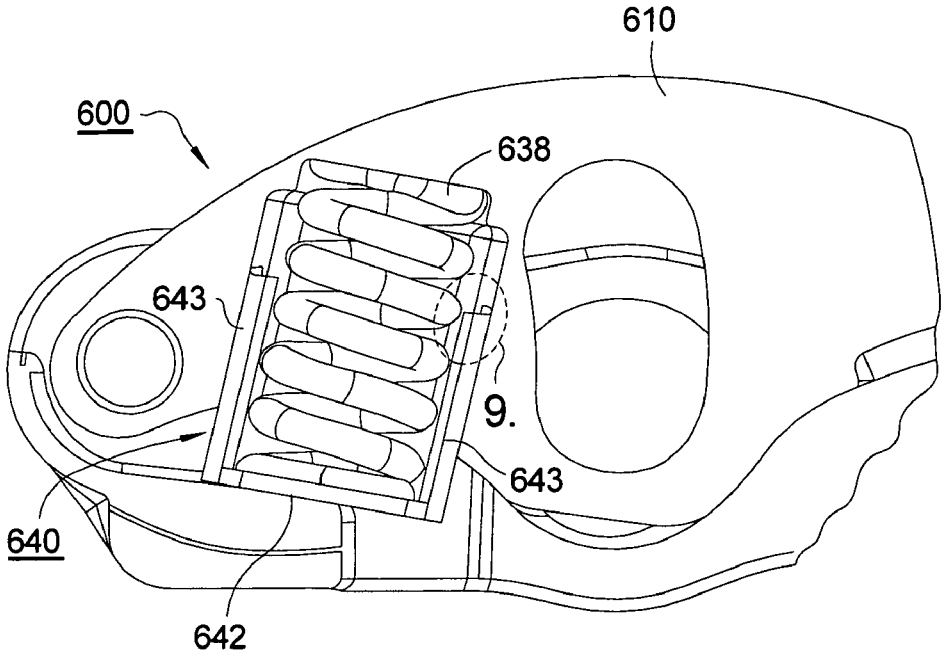
FIG. 7 is an elevational cross-sectional view of an RFF in accordance with the invention, showing a fifth alternative spring-guiding mechanism.
Figure 8:
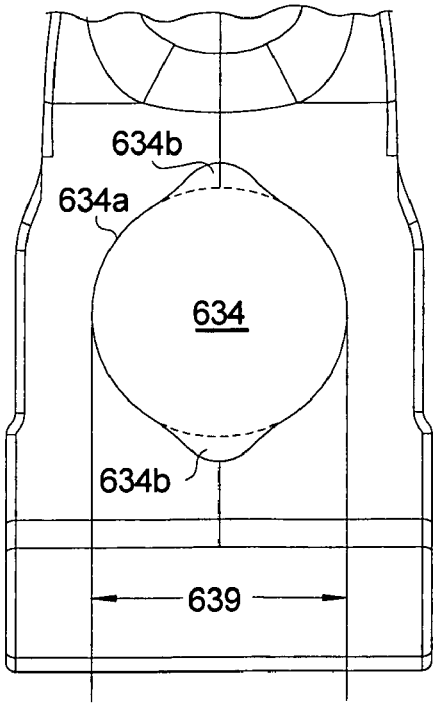
FIG. 8 is a view of the underside of the high-lift follower shown in FIG. 7, showing a non-cylindrical bore.
Figure 9:
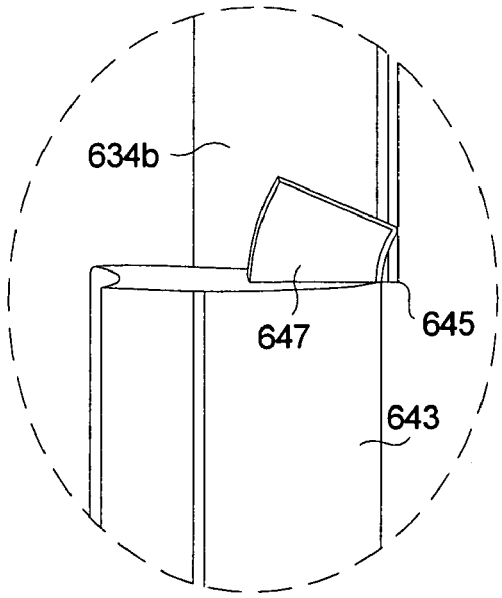
FIG. 9 is a detailed perspective view taken in region 9 of FIG. 7.

Referring now to FIGS. 7 through 9, a fifth embodiment 600 is shown wherein a compression spring 638 is able to occupy the full length and full diameter 639 of a bore 634 and yet be guided in accordance with the invention. Bore 634 includes not only a cylindrical portion 634*a*, as in the previously-disclosed embodiments, but further includes opposed channel portions 634*b* extending bore 634 along the length of high-lift follower 610 in a direction where additional space can be made available without compromising the structural capability of the follower. A spring guide 640 comprises a bottom portion 642 having a bottom surface and first and second guide rails 643 formed to conform to the cross-sectional shape of channel portions 634*b*. Preferably, channel portions 634*b* are stepped 645 and each of guide rails 643 is provided at an inner end thereof with a resilient latch 647 which expands over step 645 during assembly of the RFF to retain spring guide 640 within bore 634. Thus the travel of spring guide 640 is limited by latches 647 in the same way as the travel of spring guide 140 is limited by spring clip 182 in embodiment 100.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A roller finger follower for use in a variable valve actuation train of an internal combustion engine, comprising:

a) a low-lift cam follower having a central aperture, a first end for engaging a hydraulic lash adjuster, and a second end for engaging a valve of said engine, and including a shoe having a curved surface;

b) a high-lift cam follower disposed to pivot in said central aperture about a pivot shaft in said low-lift cam follower and having a bore opening adjacent said shoe;

c) a first compression spring disposed within said bore for action between an inner end of said bore and said shoe; and d) a spring retainer disposed between said spring and said curved surface of said shoe for guiding said spring during compression and extension thereof, said spring retainer comprises a planar bottom for engaging said curved surface and sidewalls slidably extending into said bore to guide said spring during said compression and extension, wherein said spring is substantially full-fitting within said sidewalls of said spring retainer, wherein said bore includes a step, and wherein said sidewalls include an annular groove on an outer surface thereof, and wherein a clip is disposed in said annular groove for engaging said step to limit travel of said spring retainer within said bore.

2. A roller finger follower for use in a variable valve actuation train of an internal combustion engine, comprising:

a) a low-lift cam follower having a central aperture, a first end for engaging a hydraulic lash adjuster, and a second end for engaging a valve of said engine, and including a shoe having a curled surface;

b) a high-lift cam follower disposed to pivot in said central aperture about a pivot shaft in said low-lift cam follower and having a bore opening adjacent said shoe;

c) a first compression spring disposed within said bore for action between an inner end of said bore and said shoe;

d) a second compression spring disposed within said first compression spring, said first and second compression springs are wound in opposite directions; and e) a spring retainer disposed between said spring and said curved surface of said shoe for guiding said spring during compression and extension thereof, wherein said follower includes a spring cavity and wherein a free length of one of said first and second compression springs is less than a length of said cavity when said high-lift cam follower is on a base circle portion of its associated cam lobe.

3. A two-step roller finger follower for use in a variable valve actuation train of an internal combustion engine, comprising:

a) a low-lift cam follower having a central aperture, a first end for engaging a hydraulic lash adjuster, and a second end for engaging a valve of said engine, and including a shoe having a curved surface;

b) a high-lift cam follower disposed to pivot in said central aperture about a pivot shaft in said low-lift cam follower and having a bore opening adjacent said shoe, wherein said bore includes first and second opposed channels;

c) a first compression spring disposed within said bore for action between an inner end of said bore and said shoe; and d) a spring retainer disposed between said spring and said curved surface of said shoe for guiding said spring during compression and extension thereof, wherein said curved surface is in contact with said spring retainer throughout the full pivotal motion of said high-lift cam follower relative to said low-lift cam follower, and wherein said spring retainer comprises:

a) a planar bottom for engaging said curved surface; and b) first and second linear guide rails slidably disposed in said first and second opposed channels, respectively, to guide said spring during said compression and extension.

4. A roller finger follower use in a variable valve actuation train of an internal combustion engine, comprising:

a) a low-lift cam follower having a central aperture, a first end for engaging a hydraulic lash adjuster, and a second end for engaging a valve of said engine, and including a shoe having a curved surface;

b) a high-lift cam follower disposed to pivot in said central aperture about a pivot shaft in said low-lift cam follower and having a bore opening adjacent said shoe;

c) a first compression spring disposed within said bore for action between an inner end of said bore and said shoe; and d) a spring retainer disposed between said spring and said curved surface of said shoe for guiding said spring during compression and extension thereof, wherein said bore includes first and second opposed channels, and wherein said spring retainer comprises a planar bottom for engaging said curved surface and first and second linear guide rails slidably disposed in said first and second opposed channels, respectively, to guide said spring during said compression and extension, wherein at least one of said guide rails is provided at an inner end thereof with a latch for engaging a step in said bore for limiting travel of said spring retainer within said bore.

5. A roller finger follower for use in a variable valve actuation train of an internal combustion engine, comprising:

a) a low-lift cam follower having a central aperture, a first end for engaging a hydraulic lash adjuster, and a second end for engaging a valve of said engine, and including a shoe having a curved surface;

b) a high-lift cam follower disposed to pivot in said central aperture about a pivot shaft in said low-lift cam follower and having a bore opening adjacent said shoe;

c) a first compression spring disposed within said bore for action between an inner end of said bore and said shoe; and d) a spring retainer disposed between said spring and said curved surface of said shoe for guiding said spring during compression and extension thereof, wherein said high lift follower bore further includes a counterbore at the inner end thereof, and wherein said spring retainer comprises:

a) a head portion for supporting a first end of said spring and for contacting said curved surface; and b) a stem portion attached to said head portion and extending within said spring into said counterbore.

6. A roller finger follower for use in a variable valve actuation train of an internal combustion engine, comprising:

a) a low-lift cam follower having a central aperture, a first end for engaging a hydraulic lash adjuster, and a second end for engaging a valve of said engine, and including a shoe having a curved surface;

b) a high-lift cam follower disposed to pivot in said central aperture about a pivot shaft in said low-lift cam follower and having a bore opening adjacent said shoe;

c) a first compression spring disposed within said bore for action between an inner end of said bore and said shoe; and d) a spring retainer disposed between said spring and said curved surface of said shoe for guiding said spring during compression and extension thereof, wherein said spring retainer comprises:

a) a head portion for supporting a first end of said spring;

b) a stem portion attached to said head portion and extending within said spring; and c) a guide element disposed in said bore for supporting a second end of said spring and having a central bore for receiving said stem portion.

7. A roller finger follower in accordance with claim 6 wherein said shoe is provided with a first ball socket; and wherein said bore is provided with a second ball socket at an inner end thereof; and wherein said head portion is provided with a first ball surface for mating with said first ball socket; and wherein said guide element is provided with a second ball surface for mating with said second ball socket.

* * * * *